United States Patent [19]

Norris, Jr.

[11] Patent Number: 4,880,123

[45] Date of Patent: Nov. 14, 1989

[54] METHOD FOR CONVERTING A DIGGING BOOM TO A LIFTING BOOM

[76] Inventor: Harold G. Norris, Jr., 7274 Roswell Rd., Sherrodsville, Ohio 44675

[21] Appl. No.: 192,857

[22] Filed: May 11, 1988

[51] Int. Cl.[4] ..... B23K 31/02

[52] U.S. Cl. ..... 212/177; 228/119; 228/170; 414/680; 212/270

[58] Field of Search ..... 212/175, 176, 177, 266, 212/270, 271; 228/119, 170, 189; 414/680, 718, 724, 912

[56] References Cited

U.S. PATENT DOCUMENTS

| | | | |
|---|---|---|---|
| 3,043,394 | 7/1962 | Hall | 212/177 |
| 3,977,548 | 8/1976 | McCannon et al. | 212/175 |
| 4,105,151 | 8/1978 | Eltzroth | 228/189 |
| 4,247,035 | 1/1981 | Eltzroth | 228/170 |
| 4,523,684 | 6/1985 | Baisden | 212/175 |
| 4,524,873 | 6/1985 | McGowan | 212/177 |

*Primary Examiner*—Sherman D. Basinger
*Assistant Examiner*—Stephen P. Avila
*Attorney, Agent, or Firm*—Mueller and Smith

[57] ABSTRACT

A method for converting the angulate form boom of a digging machine such as a backhoe or the like into a substantially straight lifting boom. The original angulate form boom is separated into two parts in the vicinity of the angular transition and is realigned so that the top sides are substantially co-planar. A union then is formed to rejoin the separated portion. By initially separating the boom with an elongate parting locus passing near the lifting point of the original boom, and the employment of elongate top and bottom plates, improved structural integrity is achieved and an advantageous shifting of the lifting point to the bottom of the resultant lifting boom is realized.

10 Claims, 3 Drawing Sheets

FIG. 6
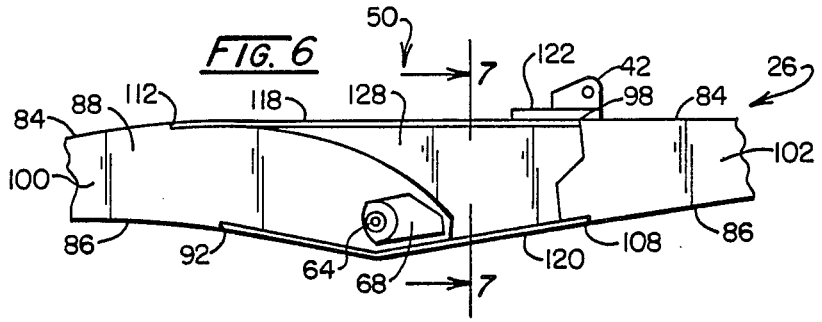
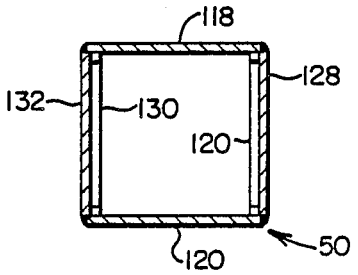
FIG. 7
FIG. 8
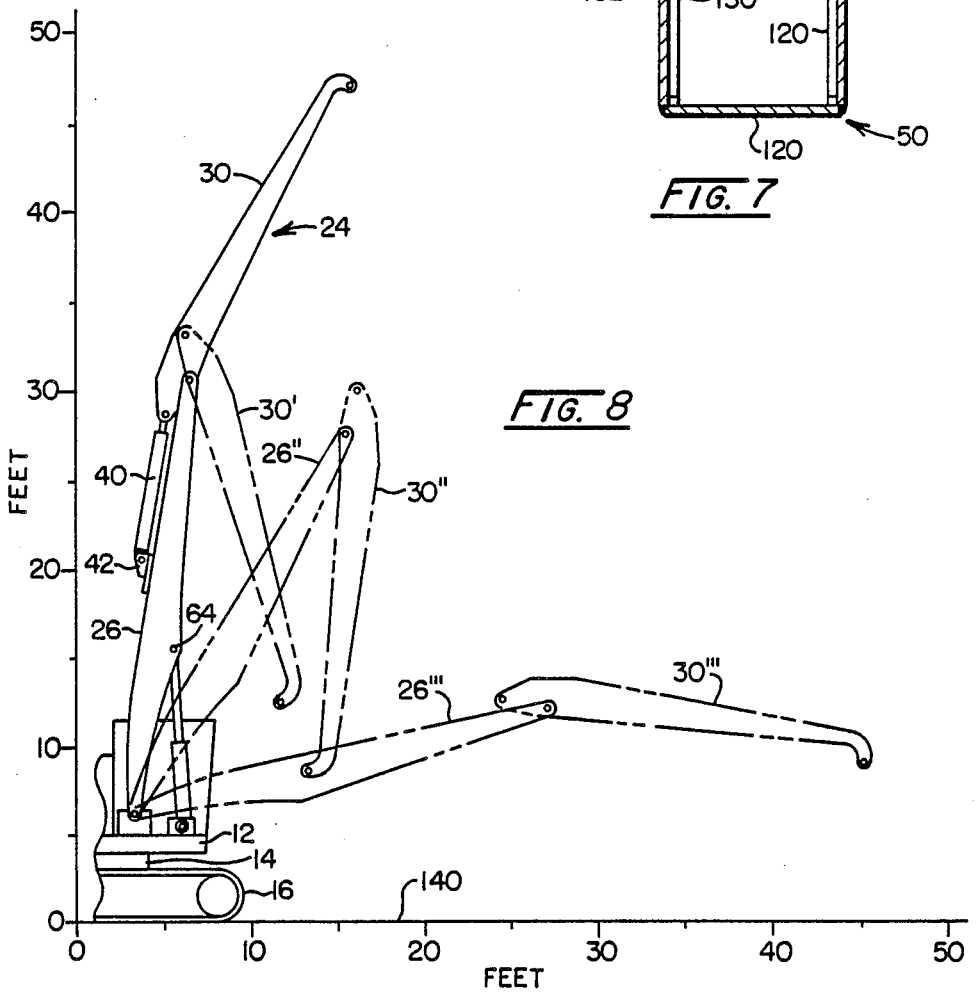

METHOD FOR CONVERTING A DIGGING BOOM TO A LIFTING BOOM

BACKGROUND OF THE INVENTION

A variety of industrial facilities have experienced a need for a crane structure having the positive manipular lifting facility and maneuvering flexibility of conventional backhoe machines. For example, such rugged crane devices may be employed with a grapple or electromagnet to move scrap material and the like from place to place, for example from storage regions into trucks, etc. Backhoe machines generally are configured incorporating a motorized maneuverable platform which additionally is pivotal about a vertical axis. The platform generally supports an operator cab, a power supply and an articulated boom assembly that includes a boom component with an inboard end pivotally coupled to the platform and having a generally angulate form to facilitate the digging function as well as a gib or outer boom pivotally coupled to the outboard end of the boom component which is conventionally referred to by operators as the "stick". The boom component is driven vertically about its inboard pivot by a hydraulic cylinder arrangement coupled between the platform and a lifting point or bearing position which is traditionally located near the angular transition or "dog leg" curve of the boom at about the mid position between the top and bottom surfaces thereof. The stick typically is driven about its pivotal connection by a hydraulic assembly extending between the stick and the boom.

Approaches for retro-fitting a backhoe to provide a crane function generally have involved techniques for effecting some straightening of the boom component. U.S. Pat. No. 4,105,151 describes one technique wherein a wedge shaped portion of the boom is cut from its top surface, leaving the bottom plate or bottom surface intact. The upper portion of the boom then is bent about the apex of the thus-formed wedge-shaped gap until the exposed edges of the side pieces and top are in contact, whereupon the assemblage is welded. The result is a shortening of the boom and the evolution of a compound curve therein.

A more popular conversion approach is described in U.S. Pat. No. 4,247,035 which provides a technique wherein a wedge form portion of the boom just above the angular transition or dog leg is removed and the upper portion thereof is bent about the top plate whereupon an insert conforming to the resultant gap is welded into the assemblage. This arrangement continues the compound curvature of the boom but provides a slight improvement in the overall reach or height made available with the resultant lifting boom. The arrangement, however, has been observed to, in effect, maneuver the lifting point or bearing position for hydraulic cylinder connection to a location proximate the upper surface of the restructured boom. As a consequence, the structural integrity of the boom has been affected resulting from time to time in breakage which, in turn, has led to further buttressing or build-up of steel surfaces about the point of compound transition or curvature. of the boom. The resultant length of this more popular retrofit arrangement still has not been found adequate. While the overall height of the articulated structure may be lengthened by increasing the length of the stick component, this expedient becomes undesirable for manipulative operations wherein the stick is withdrawn to its platform to an essentially vertical orientation suspended above ground level. For such orientations, a clearance of the stick and to the ground must be sufficient to elevate such implements as grapples and the like above the surface of the ground. For larger such implements, this clearance is insufficient for manipulation near the crane platform.

SUMMARY

The present invention is addressed to a method for converting an angulate form boom component into a lifting boom such that a backhoe or like machine may be converted into a lifting crane. The method achieves greater boom height capability with an improvement in structural integrity. such improvement in strength is achieved through the development of a union employing long, unitary and substantially straight bottom and top inserts. Additionally, the lift point or lift bearing position of the resultant lifting boom advantageously is shifted to a position proximate the bottom surface of the boom to improve accommodation of load imposed bending moment. A resultant lift boom is aesthetically pleasing, having substantially no angular deformations as were necessitated in earlier boom conversion approaches.

Another feature of the invention is to provide a method for converting an angulate form boom component into a lifting beam, the angulate form boom having an angulate transition region with oppositely disposed sides extending between top and bottom portions and a lift bearing position at said side located proximate the angulate transition of the boom component, the method comprising the steps of:

cutting the boom into first and second separate parts along a parting locus extending within the angulate transition region from a predetermined position at the bottom of the boom through the sides, passing adjacent the lift bearing position and to a second predetermined position at the top of the boom;

separating the first and second parts a select, spaced-apart distance;

aligning th top of the first part with the top of the second part substantially to a co-planar relationship minimizing the angulate transition;

providing a top insert extending from a third predetermined position at the first part top substantially to the second predetermined position;

providing a bottom insert extending from the first position at the first part bottom side to a fourth predetermined position at the second part bottom side;

providing side inserts having configurations conforming with the openings defined between the bottom and top inserts; and securing the top, bottom and side inserts with the first and second parts to form a lifting boom.

The invention, accordingly, comprises the method possessing the steps which are exemplified in the following detailed disclosure.

For a fuller understanding of the nature and objects of the invention, reference should be had to the following detailed description taken in conjunction with the accompanying drawings.

BRIEF DESCRIPTION OF THE DRAWINGS

FIG. 6 is a side view of the structure of FIG. 5 showing a side insert positioning;

FIG. 7 is a sectional view of the boom component of FIG. 6 taken through the plane 7—7 shown therein; and FIG. 8 is a partial schematic view of the structure of FIG. 1 showing orientations of the articulated boom structure thereof.

DETAILED DESCRIPTION

Figure 1:
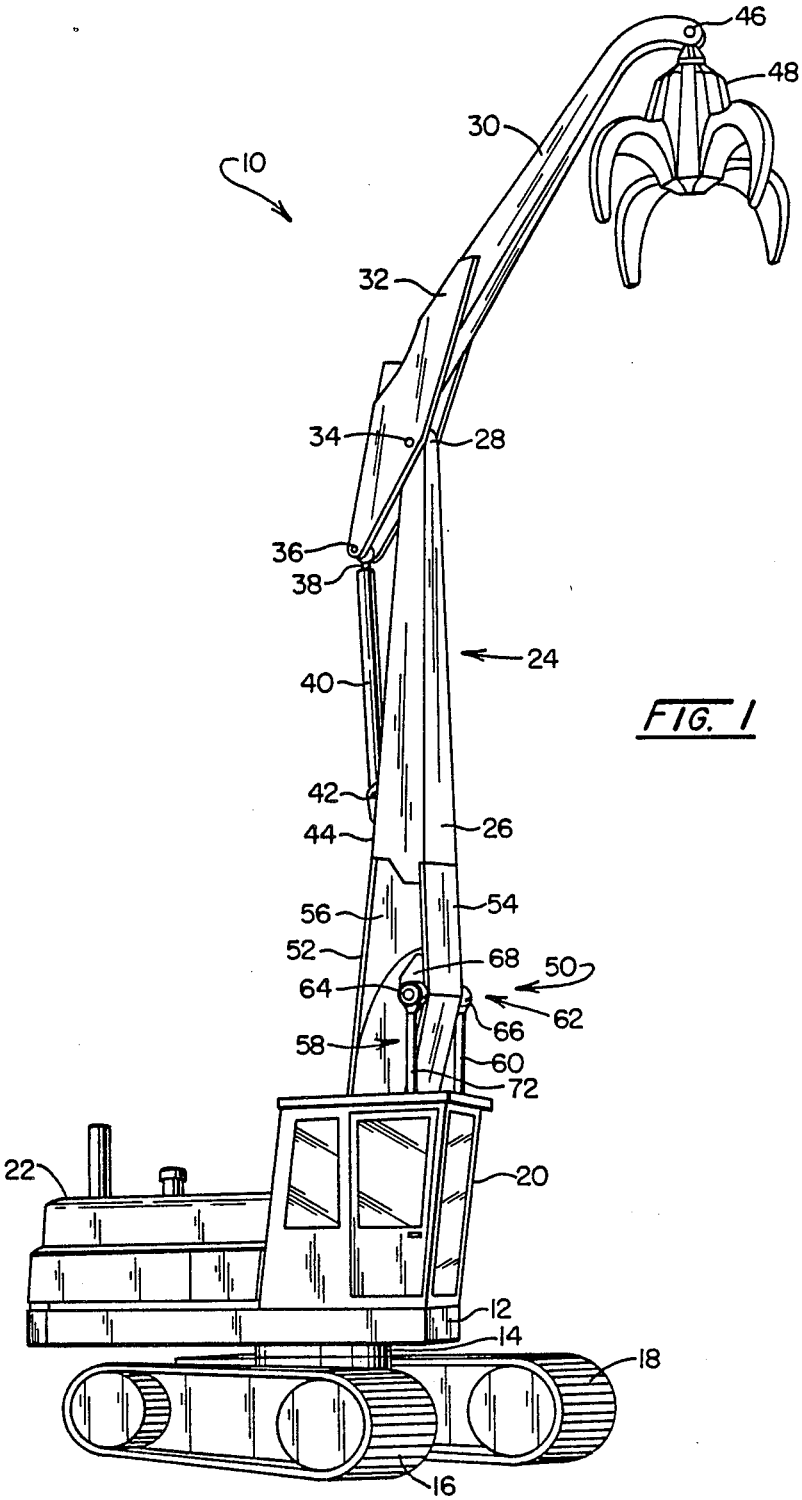
FIG. 1 is a pictorial representation of a backhoe structure having been converted into a lifting crane in accordance with the instant invention.

The crane structure developed with the method of the invention achieves improved height and reach for the crane function while developing a boom structure of enhanced structural rigidity and load bearing capacity. Looking to FIG. 1, a backhoe device having been converted to such a crane structure is represented generally at 10. The crane 10 includes a platform 12 which is mounted for rotation about a vertical axis by a bearing 14 supported, in turn, by a pair of driven tracks 16 and 18. Platform 12 additionally supports a cab 20 within which operator controls are positioned and a power supply provided, for example, as an internal combustion engine is shown at 22. Pivotally mounted upon the platform 12 is an articulated boom structure represented generally at 24 which includes a boom component 26 which is pivotally mounted at its base pivot (see FIGS. 2 and 8) to platform 12 and the opposite end or outboard end of which 28 functions to provide a pivot connection with the inboard end of gib boom or stick 30. In the latter regard, a large bracket 32 is seen pivoted to the outboard end 28 of boom 26 via pin 34 and the bracket is seen to extend outwardly from the latter pin to a pin connection 36 with the piston 38 of a hydraulic cylinder actuator 40, the opposite end of which is seen to be pivotally coupled to a bracket 42 fixed to and extending outwardly from the top side 44 of boom 26.

Stick or gibe 30 is seen extending to an outboard pivot connection 46 to which is coupled a grapple 48. Such devices as grapple 48, will have a top to bottom length, for example as extensive as about 11 feet.

The boom component 24, as revised with respect to its original angulate form is advantageously uniform and straight due to a union 50 provided in accordance with the method of the instant invention. Union 50 is seen to comprise a top insert 52, a bottom insert 54, and two substantially identical side inserts, one of which is shown at 56. Boom 24 is driven by two hydraulic cylinder assemblages 58 and 60 which are respectively attached to a lift point or lift bearing position shown generally at 62 at respective pin connections 63 and 66. These pin connections generally are incorporated within a reinforcing bracket, one of which is shown at 68. Looking momentarily to FIG. 2, the bracket 68 and pin junction 64 is represented in conjunction with the pivotal connection of boom 26 with platform 12. In this regard, one of the pin couplings for the structure is shown at 70, while the hydraulic assembly 58 is shown to include a piston rod 72 coupled with pin 64, a cylinder 74, and a pin coupling 76 connecting the cylinder with platform 12.

Figure 3:
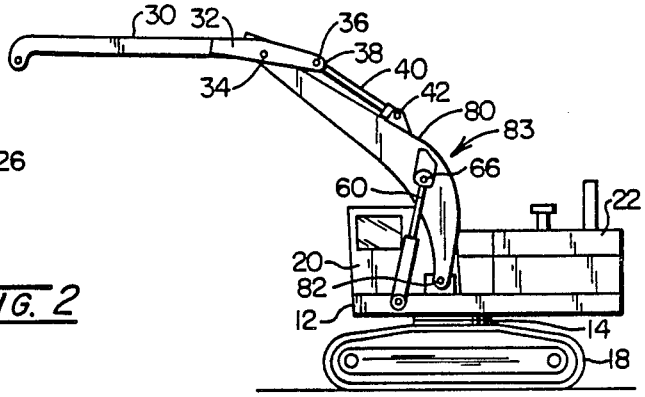
FIG. 3 PRIOR ART
FIG. 3 is a side schematic view of a backhoe structure representing typical devices which are converted to provide the crane of FIG. 1.

The elongate and straight boom structure 26 is developed from the knuckle boom or angulate form boom component of a backhoe. Referring to FIG. 3, such a boom structure prior to its adaptation according to the invention is represented at 80. In this regard, a boom 80 is shown pivotally connected to platform 12 at a pin assembly 82 positioned adjacent earlier described assembly 70. The boom 80 is retained in position by hydraulic assembly 60 in addition to earlier-described assembly 58 which is positioned parallel with the former. Gib boom or stick 30 includes the earlier-described bracket 32 providing for a pin coupling or pivotal connection 34 with the outboard end of boom 80. The cylinder 40 and piston rod 38 arrangement of FIG. 1 again is reproduced in conjunction with bracket 42 coupled to boom 80, the piston rod 38 being connected at pin connection 36 with bracket 32. Under the method of the invention, the boom 80 is converted to the structure represented at 26 in FIG. 1, whereupon it is remounted upon platform 12 and reassociated with stick 30 and the hydraulic assemblies.

Figure 4:
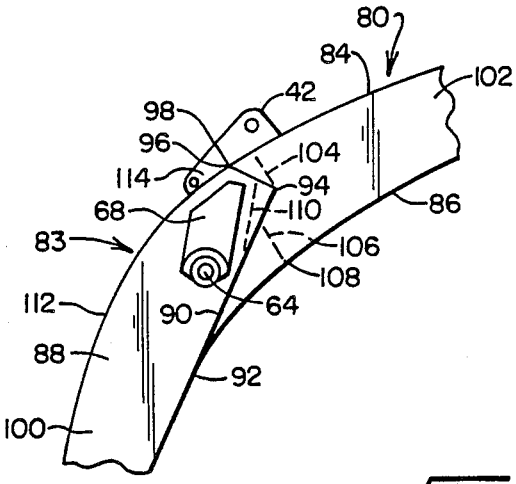
FIG. 4 is a sectional side view of a portion of the boom component represented in FIG. 3 showing cut or parting lines and trim lines illustrating the method of the invention.

It may be observed that the boom 80 is characterized in a configuration having an angulate transition represented generally at region 83. Referring to FIG. 4, this region 83 for the boom 80 is reproduced. The region 83 is shown to be in the form of a curvature, however, depending upon the backhoe manufacturer, the transition region may take a variety of shapes, however, all have the equivalent of the noted transition. Boom 80 conventionally will have a box-like structure formed of plate steel and will include a top 84, a bottom 86, and oppositely disposed sides, one of which is represented at 88. Under the method of the invention, the boom 80 is cut into two distinct, separate parts by cutting along a line or parting locus represented at 90, the line 90 representing a plane wherein each of the oppositely-disposed sides of the boom 80 are cut through as well as the top and bottom surfaces. Line 90 is seen to commence at a first position 92 located in region 83 at the bottom side 86 of boom 80. The parting locus 90 extends in a substantially straight line from first position 92 in somewhat close proximity to the pivot 64 and bracket 68. It may be observed that the lift point 64 within the backhoe boom 80 is located somewhat in the middle of the boom. By so cutting from position 92 along cut line 90 to position 94, the final position of the lift point 64 in the completed boom 26 will be seen to be maneuvered to the bottom region of the boom. From position 94, the cut line 90 then is turned by an angle of about 90° to extend to a second position 96. From second position 96, the cut extends through the pivot bracket 42 (which is removed and reinstalled) to position 98. When so cut, the boom 80 has two separate pieces, one represented at 100 containing th top side 84 within region 83 and the other at 102 containing the bottom side 86 within region 83. Additional cuts are made from pieces 100 and 102 by way of trimming, for example, as represented by dashed line 104 a portion is cut from piece 102 leading to bracket 42. Additionally, as represented by dashed line 106, a portion is removed from piece 102 extending from line 94 to a fourth position 108. Further, as represented by dashed line 110, a component is cut from piece 100 in parallel with the side of bracket 68 which will be seen to permit even a closer proximity of lift point 64 with the bottom of the resultant boom 26.

Finally, the top side or surface of piece 100 is cut or removed between second position 96 and a third position 112. This removal necessarily additionally removes a portion 114 of bracket 42. While the latter trim cuts can be made as part of the initial separation procedure, the multi-cutting or trim approach involving the cutting locuses 104, 106, and 110 is found to be preferred.

Figure 2:
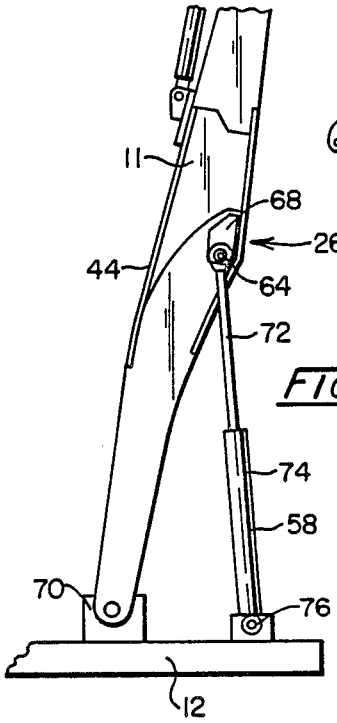
FIG. 2 is a partial side view of the structure of FIG. 1 showing a boom component lifting position.
Figure 5:
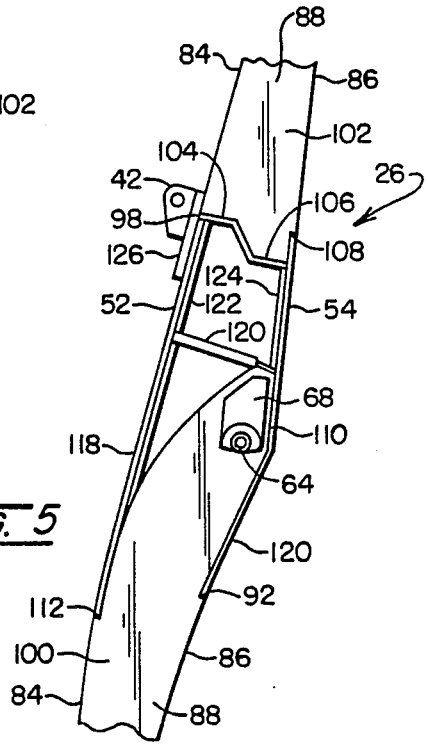
FIG. 5 is a side view of a boom component during alteration according to the method of the invention prior to the application of side inserts.

Turning to FIG. 5, the parts 100 and 102 are seen to be spaced apart a distance selected with respect to the desired overall length of the boom 26. In addition to this spacing, the parts 100 and 102 are aligned such that the top surfaces 84 thereof assume a substantially coplanar relationship which is selected to minimize the angular transition region 83. Additionally, the top plate forming top surface 84 is removed from part 100. A union then is constructed to structurally reassociate parts 100 and 102. The union 50 is formed of a top insert 118 extending from position 112 to position 98 and welded to the sides thereof and across the top. This substantially straight, flat steel plate 118 also may be supported by an internal frame including components 120, 122, and 124. In general, the steel plate 118 will be configured to conform with top 84 of the beam as seen in FIG. 1. In similar fashion, a bottom insert is provided 108 and, preferably, is a continuous piece. Note that it is in close proximity to the lift point 54 and bracket 68. Plate 120 also is welded into position. It may be observed that bracket 42 having been removed for fabricating convenience, then is welded into position, preferably utilizing a supportive bottom plate as at 126. Side inserts then are cut and, looking additionally to FIG. 6, are welded into position on each side of the resultant boom as represented at 128. The resultant union 50 is structurally rigid inter alia due to the utilization of somewhat lengthy unitary or integral top and bottom pieces 118 and 120 extending as noted, between second and third positions 98 and 112 and first and fourth positions 92 and 108. Where desired, additional reinforcing can be added to the union 50. Further, the lift point 64 now advantageously is at the bottom of boom 26 to improve the capability of the boom to withstand load stresses at this structurally critical location, i.e. load imposed bending moment. Looking to FIG. 7, a sectional view of union 50 is revealed. The top and bottom inserts shown respectively at 118 and 120 are revealed in section as well as internal frame angle 120 and a corresponding frame angle 130. The side plate insert 128 is shown as well as the complementary opposite side plate represented at 132.

Referring to FIG. 8, a representation of a typical height, reach and articulation capability for cranes developed according to the method of the invention is revealed along with an appropriate scaling. It may be observed that the additional height available with the boom component 26 provides, for example, a height capability of about 52 feet as represented at 26 and 30. Further, the stick or gib boom may be pivoted downwardly and inwardly toward the platform 12 as represented in phantom at 30' to provide, for example, about 13½ feet of clearance to ground level as at 140. The stick component can be lowered toward the ground by lowering the boom component 26 as shown at 26''-30'' in phantom. Finally, a somewhat significant reach of around 52 feet for the articulated structural 24 can be derived as represented in phantom at 26'''-30'''.

Since certain changes may be made in the above-described method without departing from the scope of the invention herein involved, it is intended that all matter contained in the description thereof of shown in the accompanying drawings shall be interpreted as illustrative and not in a limiting sense.

I claim:

1. A method for converting an angulate form boom component into a lifting boom, said angulate form boom having an angulate transition region with oppositely disposed sides extending between top and bottom sides and having a lift bearing position at said sides located proximate the angulate transition region of said boom component, the method comprising the steps of:

cutting said boom into first and second separate parts along a parting locus extending within said angulate transition region from a first predetermined position at said bottom through said sides, passing adjacent said lift bearing position t a second predetermined position at said top;

separating said first and second parts a select, spaced-apart distance;

aligning the top side of said first part with the top side of said second part substantially t a co-planar relationship minimizing said angulate transition;

providing a top insert extending from a third predetermined position at said first part top side substantially to said second predetermined position;

providing a bottom insert extending from said first predetermined position at said first part bottom side to a fourth predetermined position at said second part bottom side;

providing side inserts having configurations conforming with the openings defined between said bottom and top inserts;

securing said top, bottom and side inserts with said first and second parts to form a lifting boom.

2. The method of claim 1 in which said top insert is provided as a substantially straight, flat steel plate.

3. The method of claim 1 in which said cutting step is carried out in a manner wherein said top side within the said angulate transition region remains with said first part, and said bottom side within said angulate transition region remains with said second part.

4. The method of claim 3 in which said third predetermined position is adjacent the commencement of said first part angulate transition region; and including the step of removing said top side between said third predetermined position and the said second position parting end of said first part prior to said securing of said top insert.

5. The method of claim 3 in which said fourth predetermined position is located at about the commencement of said angulate transition region at said bottom side; and including the step of removing that portion of said second part incorporating said bottom side angulate transition region from the said first position parting end thereof to said fourth predetermined position.

6. The method of claim 1 in which said parting locus from said first predetermined position to a position adjacent said lift bearing position is substantially straight.

7. The method of claim 6 in which said first predetermined position is at about the commencement of said angulate transition region at said bottom side.

8. The method of claim 6 in which said third predetermined position is adjacent the commencement of said first part angulate transition region; and including the step of removing said top side between said third predetermined position and the said second position parting end of said first part prior to said securing of said top insert.

9. The method of claim 5 in which said fourth predetermined position is locate at about the commencement of said angulate transition region at said bottom side; and including the step of removing that portion of said second part incorporating said bottom side angulate transition region from the said first position parting end thereof to said fourth predetermined position.

10. The method of claim 9 in which said top insert is provided as a substantially straight, flat steel plate.

* * * * *